US005957677A

United States Patent [19]

Hill et al.

[11] Patent Number: 5,957,677

[45] Date of Patent: Sep. 28, 1999

[54] ROTARY LOBE PUMP WITH MAGNETIC ROTOR RETENTION SYSTEM

[75] Inventors: Ian Hill, Eastbourne; Thomas Fuggle, Pound Green; Kenneth Smith, Camden Hill, all of United Kingdom

[73] Assignee: Alfa Laval Flow GmbH, Dusseldorf, Germany

[21] Appl. No.: 08/829,932

[22] Filed: Mar. 31, 1997

[30] Foreign Application Priority Data

Apr. 3, 1996 [DE] Germany ..... 196 13 148

[51] Int. Cl.[6] ..... F04C 2/18

[52] U.S. Cl. ..... 418/107; 418/206.1; 418/206.6; 418/206.9; 403/359; 403/DIG. 1

[58] Field of Search ..... 418/70, 104, 107, 418/158, 206.1, 206.6, 206.9; 403/359, DIG. 1

[56] References Cited

U.S. PATENT DOCUMENTS

| | | | |
|---|---|---|---|
| 4,621,994 | 11/1986 | Ellis | 418/70 |
| 5,249,940 | 10/1993 | Matsuda | 418/55.5 |
| 5,391,068 | 2/1995 | Uppal | 418/206.1 |

FOREIGN PATENT DOCUMENTS

| | | | |
|---|---|---|---|
| 0 157 049 A2 | 10/1985 | European Pat. Off. . | |
| 4024067 | 1/1992 | Germany | 418/206 |

*Primary Examiner*—John J. Vrablik

*Attorney, Agent, or Firm*—Milton Oliver; Ware, Fressola, Van Der Sluys & Adolphson LLP

[57] ABSTRACT

An improved rotary lobe pump has a pumping chamber (1) having a housing (2) closed by a front wall (3)and a rear wall (6). The front housing wall (3) is secured to the housing (2) by bolts (4) and is sealed with a gasket (5). The housing (2) comprises a rear housing wall (6) running parallel with the front housing wall (3). The rear housing wall (6) includes an orifice designed in the form of a sealing hub (7) through which a drive shaft (7) enters the pumping chamber (1). A rotor in the form of a rotary lobe piston (10) can be slidably placed on that end (9) of the drive shaft (8) which projects into the pumping chamber (1). Provided on the rotary lobe piston (10) and integral therewith is an axial extension in the form of a sleeve (13) which surrounds the drive shaft (8) and passes through the sealed hub (7) the seal (20) surrounding the hub (7) is thus in contact with the sleeve (13). The sleeve (13) comprises a bead-shaped edge (13*a*) by which it pushes against a stop (14) surrounding the drive shaft (8) in an annular configuration. This stop limits the axial displacement of the rotary drive piston (10) in the direction of the rear housing wall (6).

11 Claims, 7 Drawing Sheets

ROTARY LOBE PUMP WITH MAGNETIC ROTOR RETENTION SYSTEM

FIELD OF THE INVENTION

The invention relates to a pump and more particularly, to a rotary lobe pump having at least one rotor revolving in a pumping chamber, said rotor being slidably placed on the end of a drive shaft projecting into said pumping chamber.

BACKGROUND

It is a distinctive feature of rotary lobe pumps that they provide a particularly gentle positive fluid transfer. Moreover, their pumping chamber is easily accessible and can be effectively cleaned upon removal of the rotor. For the above-mentioned reasons, rotary lobe pumps meet very stringent hygiene standards and are preferred in food production applications, pharmaceutical processes and biotechnology.

On known rotary lobe pumps, the rotors can be pulled off the drive shaft ends, projecting into the pumping chamber, once the front housing wall has been removed. In order to ensure an accurate positioning of the rotor in the direction of rotation, the drive shaft ends are provided with a gear rim. The retention of the rotor against axial displacement on the drive shaft is achieved outside the pumping chamber in rotary lobe pumps of known design. For this purpose, a sleeve attached to the rotor is passed through the sealing hub in such a manner that a bead-shaped edge of this sleeve presses against a corresponding ring surrounding the drive shaft outside the pumping chamber. The bead-shaped edge and the ring are secured relative to each other by means of a detachable clamp.

One disadvantage of the prior retention system lies in the fact that the removal, and particularly the installation of the clamp, is a highly complex and time-consuming process. Thus, a tool is necessary to loosen the bolts and to remove the clamp, which itself comprises two half-shells enclosing the shaft and the sleeve. To provide adequate handling access to the clamps, these must be surrounded by a sufficient clearance. The distance between the pumping chamber and the housing of the coupling must be large enough to accommodate a fitter's hand. As the clamp is so awkward to handle, maintenance and cleaning work on the pump is fairly complicated and inconvenient to perform.

SUMMARY OF THE INVENTION

It is an object of the invention to provide a pump and, more particularly, a rotary pump having at least one rotor wherein this rotor is easily removable from the drive shaft, and wherein the pumping chamber can be easily and thoroughly cleaned.

According to the invention, this object is achieved by a pump design in which the rotor, or a part connected thereto, is retained in its axial position by a magnetic force.

A key advantage of the pump according to the invention, and of retaining the rotors on the drive shafts by means of magnetic forces provided by magnets, lies in the fact that, upon removal of the front housing wall, these rotors can be pulled off the drive shaft ends projecting into the pumping chamber with a few easy manual operations and without the use of additional tools. In a preferred embodiment, the front cover can be reversed, to extract the rotors, using the attractive force of the magnet located in the front cover. The installation of a rotor on a drive shaft is indeed so convenient to perform that it can also be carried out by a machine.

Moreover, the magnetic retention systems according to the invention allows a particularly compact pump design, as there is no need to provide any particular clearance for handling the connection between the rotor and the drive shaft. The magnetic forces can be provided by permanent magnets lies in the fact that they produce strong magnetic forces even without an additional electric power supply. Moreover, such permanent magnets can be fitted in the rotors or housing portions in any desired location. Electromagnets, on the other hand, offer the advantage that the magnetic force can be activated and de-activated at will. With the magnets de-energized, the rotors are particularly easy to remove.

Another advantage of the magnetic retention system lies in the fact that it can be used for any tape of pump having a rotor secured on a drive shaft. In the specific case of rotary lobe pumps, a particularly advantageous way of ensuring the axial retention of the rotors (rotary lobe pistons) on the drive shaft is to cause the rotor or a part connected thereto (such as, particularly, a sleeve) to be pressed against a stop by magnetic force. This stop is preferably a ring surrounding the drive shaft. With the handling of the front housing cover and rotors thus simplified, the pumping chamber of a rotary lobe pump can be conveniently serviced and cleaned in a manner requiring a minimum of manual operations. In addition, the rotary lobe pump according to the invention has the advantage of containing no gaps (except for the sealing hub) in which fluid may accumulate and promote the growth of microorganisms.

In one advantageous design, magnets inserted in the front housing wall exert a repelling force on rotor surfaces located centrally underneath, and directed towards, this the rotors can be easily extracted, as there are no longer any retaining forces present.

To prevent the formation of eddy currents, it is advantageous to provide a magnet in the rotor in such a manner that it exerts an attracting force on the revolving front end of the drive shaft. In order to increase this attracting force between the drive shaft end and the rotor, it is furthermore advantageous to fit another magnet in the end of the drive shaft, such magnet to be arranged across from the rotor magnet with appropriate opposite polarity. In one specific embodiment of the rotary lobe pump a magnet is provided in a circular configuration around the end of a sleeve which is integral with the rotor. This magnet exerts an attracting force on an annular projection (or an annular magnet) provided on the circumference of the shaft.

In another embodiment of the invention, a plurality of magnets are fitted in the rotor surfaces facing the rear housing wall of the pumping chamber. In order to increase the attracting force of these magnets, it is advantageous to provide another set of magnets in the rear housing wall, such magnets to be specifically arranged in an annular configuration to achieve a uniform distribution of the attracting forces.

BRIEF FIGURE DESCRIPTION

Embodiments of the pump according to the invention are described hereinbelow with reference to the accompanying FIGS. 1 through 5, wherein FIG. 1 shows a side view through a pumping chamber in which magnets are fitted in the front housing wall and in the rotary lobe piston.

DETAILED DESCRIPTION

Figure 1:
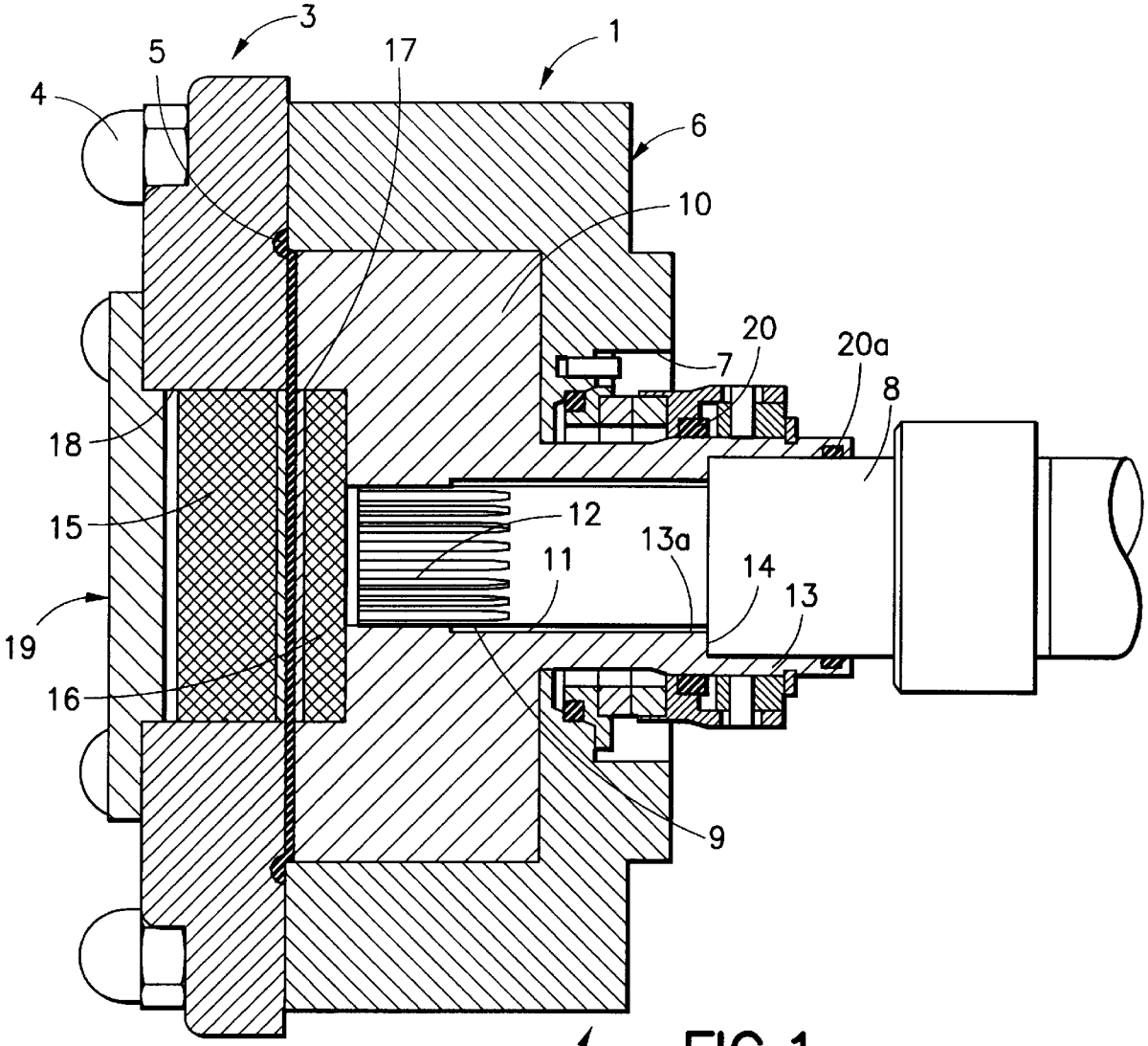

FIGS. 1 through 6 each show the pumping chamber 1 of a rotary lobe pump. This pumping chamber 1 comprises a housing 2 closed by a front housing wall 3. The front housing wall 3 is secured to the housing 2 by bolts 4 and is sealed with a gasket 5. The housing 2 comprises a rear housing wall 6 running parallel with the front housing wall 3. The rear housing wall 6 includes an orifice designed in the form of sealing hub 7, through which a drive shaft 8 enters the pumping chamber 1. A rotor in the form of a rotary lobe piston 10 can be slidably placed on that end 9 of the drive shaft 8 which projects into the pumping chamber 1. When the rotor is placed on the shaft, a plurality of teeth provided in the recess 11 of the rotary lobe piston 10 engage a tooth contour 12 provided on the shaft end 9. The recess 11 is not a bored through-hole. If desired, two rotors may be provided.

Provided on the rotary lobe piston 10 and integral therewith is an axial extension in the form of a sleeve 13 which surrounds the drive shaft 8 and passes through the sealed hub 7. The seal 20 surrounding the hub 7 is thus in contact with the sleeve 13. The sleeve 13 comprises a bead-shaped edge 13*a* by which it pushes against a stop 14 surrounding the drive shaft 8 in an annular configuration. This stop limits the axial displacement of the rotary lobe piston 10 in the direction of the rear housing wall 6. Into the inner wall of the sleeve 13, a groove is formed, into which a sealing ring (O-ring) 20*a* is inserted. This O-ring seals the sleeve 13 with respect to the drive shaft 8, so that no contaminants can penetrate to the radially outwardly-directed surface which forms the axial stop. The effect of the sleeve 13, which projects out of the pumping chamber 1 and is sealed off against the housing 2, is to eliminate gaps in the pumping chamber 1 between the drive shaft 8 and the rotary lobe piston 10, i.e., gaps in which the pumped fluid might accumulate. As the rotary lobe piston 10 presents a closed surface at its front end, the drive shaft is fully sealed off against the pumped fluid.

Figure 5A:
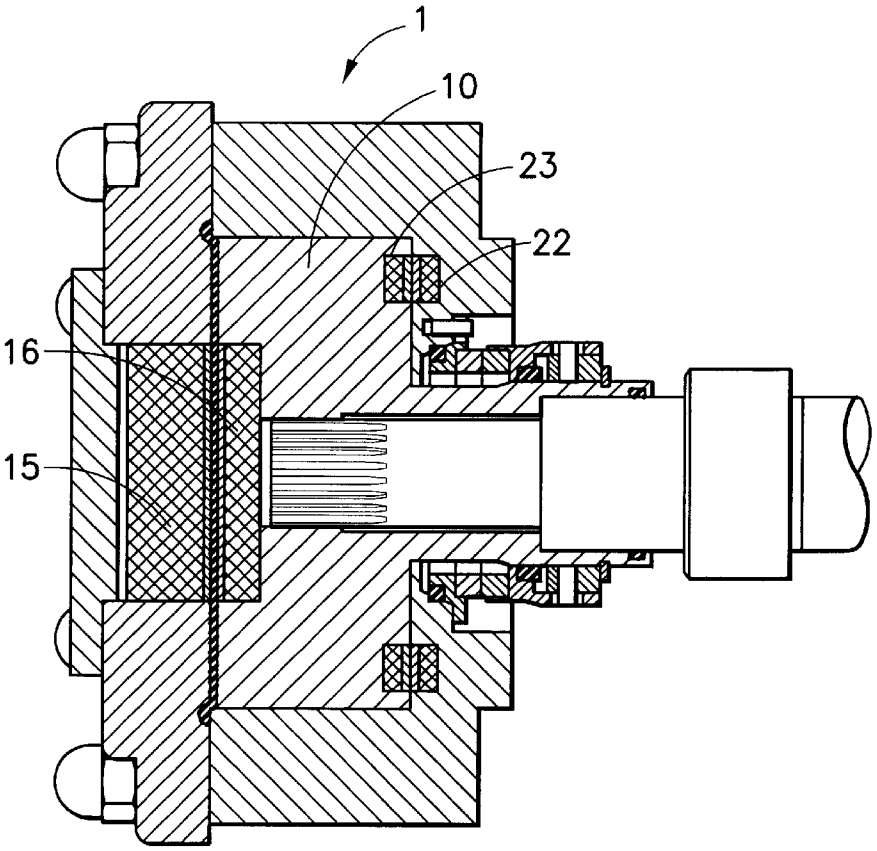
FIG. 5A shows a pumping chamber with magnets exerting attracting and repelling forces, respectively.
Figure 5B:
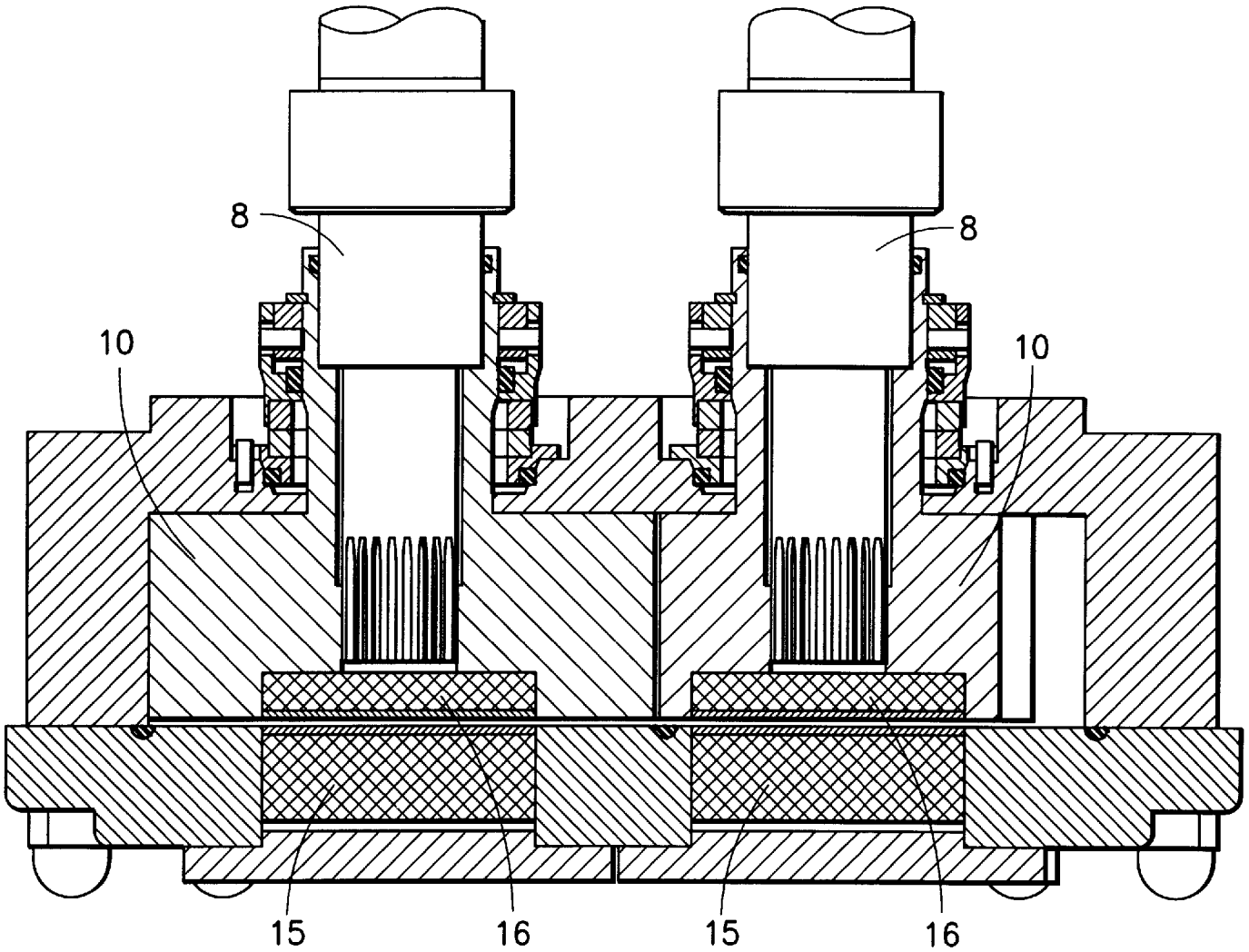
FIG. 5B shows a dual-rotor version thereof.

In the embodiment shown in FIGS. 1 and 5B an axial displacement of the rotary lobe piston in the direction of the front housing wall 3 is provided by magnetic forces produced by two magnets 15 and 16. For this purpose the magnet 15 is fitted in the front housing wall while the magnet 16 is arranged in the rotary lobe piston 10 behind a thin wall member 17. The polarity of the magnets 15 and 16 is such that they repel each other. The magnet 15 is fitted in a blind hole 18 provided in the front housing wall 3 and closed with a cover 19. The repelling forces of the magnets press the rotary lobe piston 10 with its attached sleeve 13 against the stop 14, thereby preventing any displacement of the rotary lobe impeller on its drive shaft 8. The axial force of the magnets closes the mechanical seal. In FIG. 2B magnet 15 of FIG. 1 is replaced by electromagnet 35.

Figure 2A:
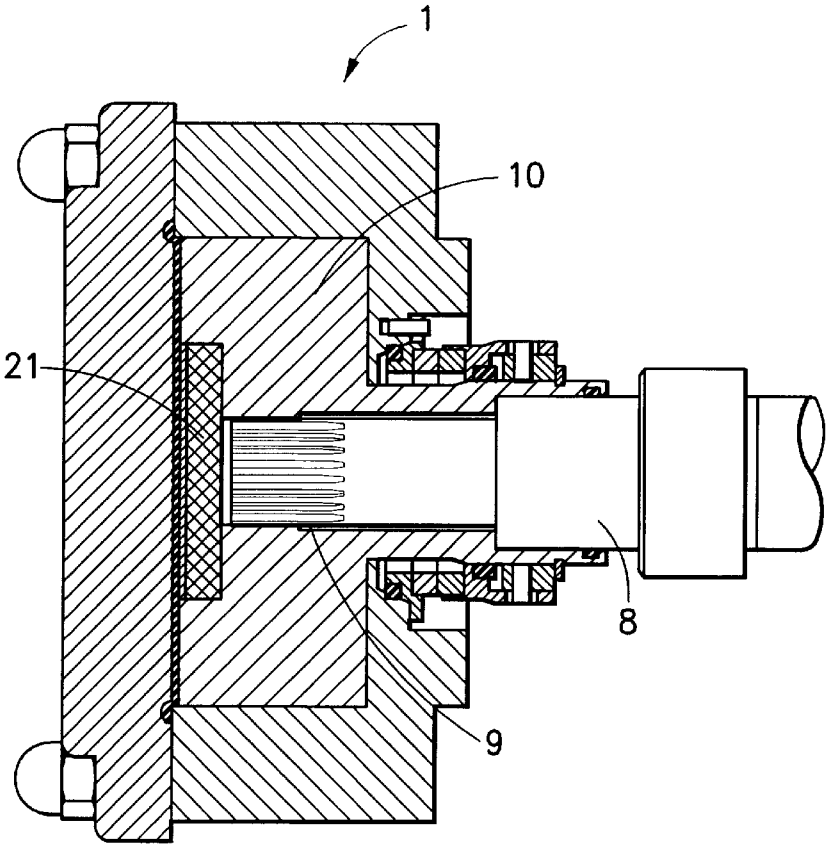
FIG. 2A shows a pumping chamber with a magnet acting on the drive shaft.
Figure 6:
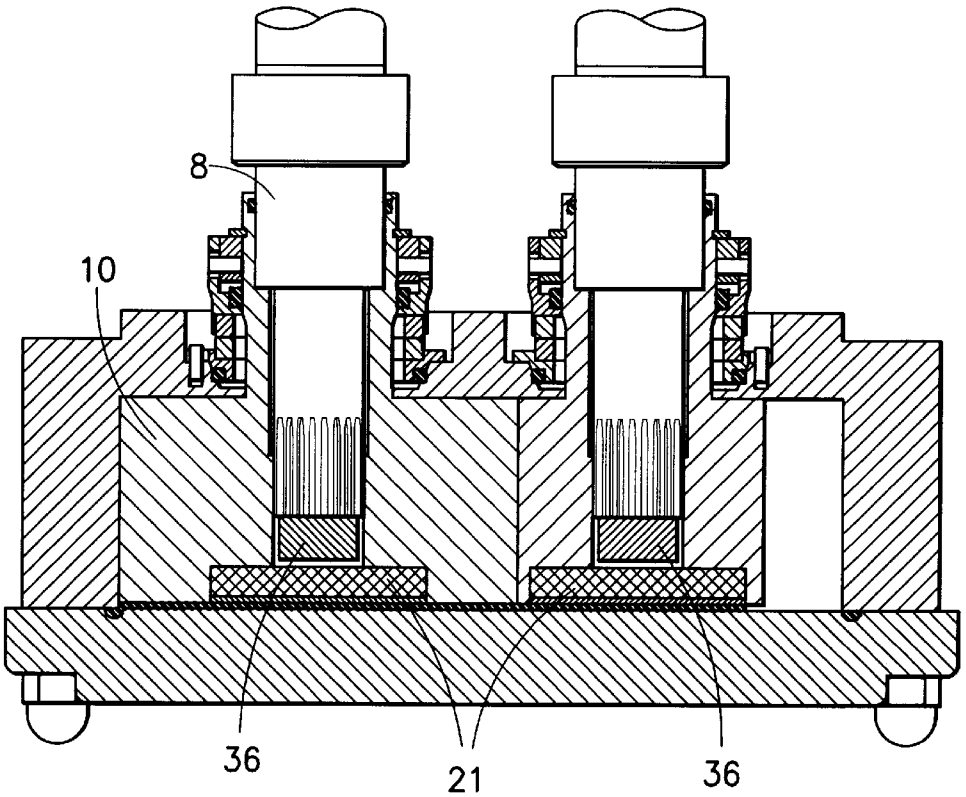
FIG. 6 shows a dual-rotor version with a respective magnet on the end of each drive shaft.
Figure 2B:
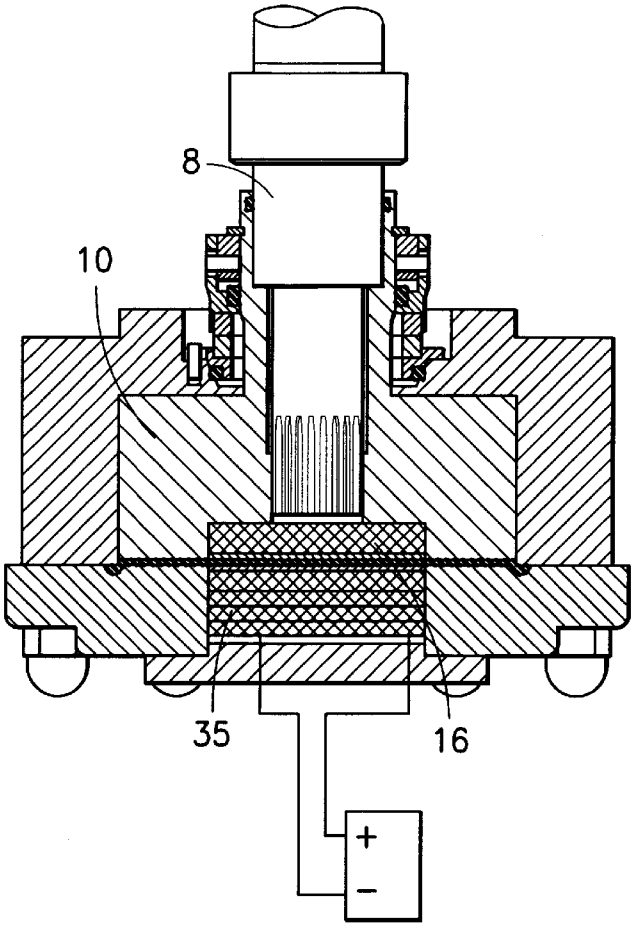
FIG. 2B shows a variation using an electromagnet.
Figure 4A:
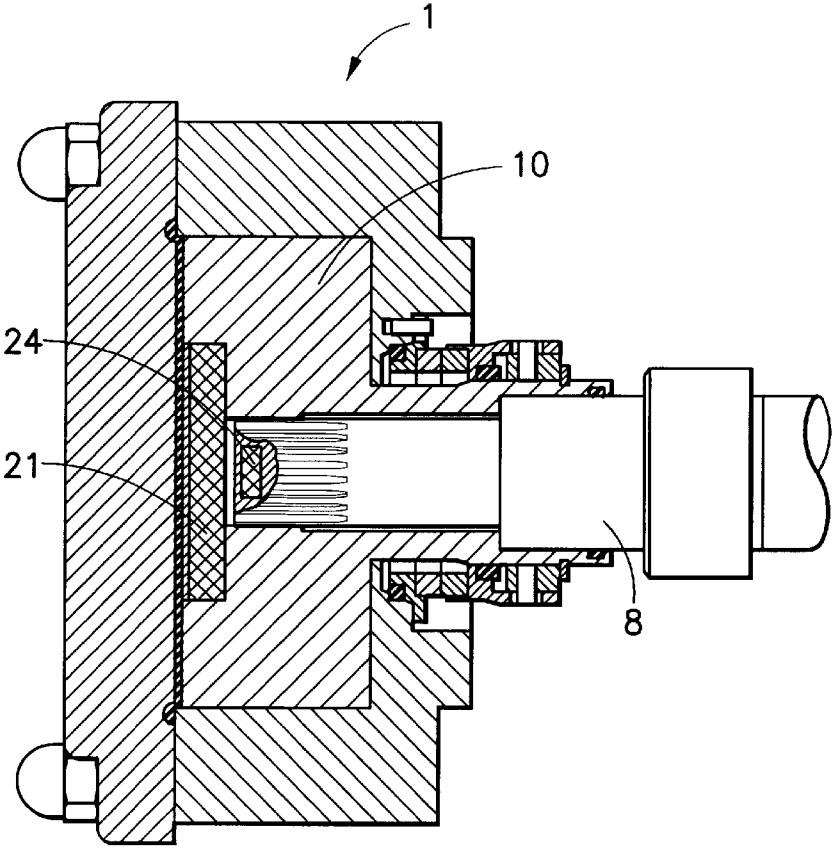
FIG. 4A shows pumping chamber with a plurality of magnets fitted in the rotary lobe pistons and in the end of the drive shaft.
Figure 4B:
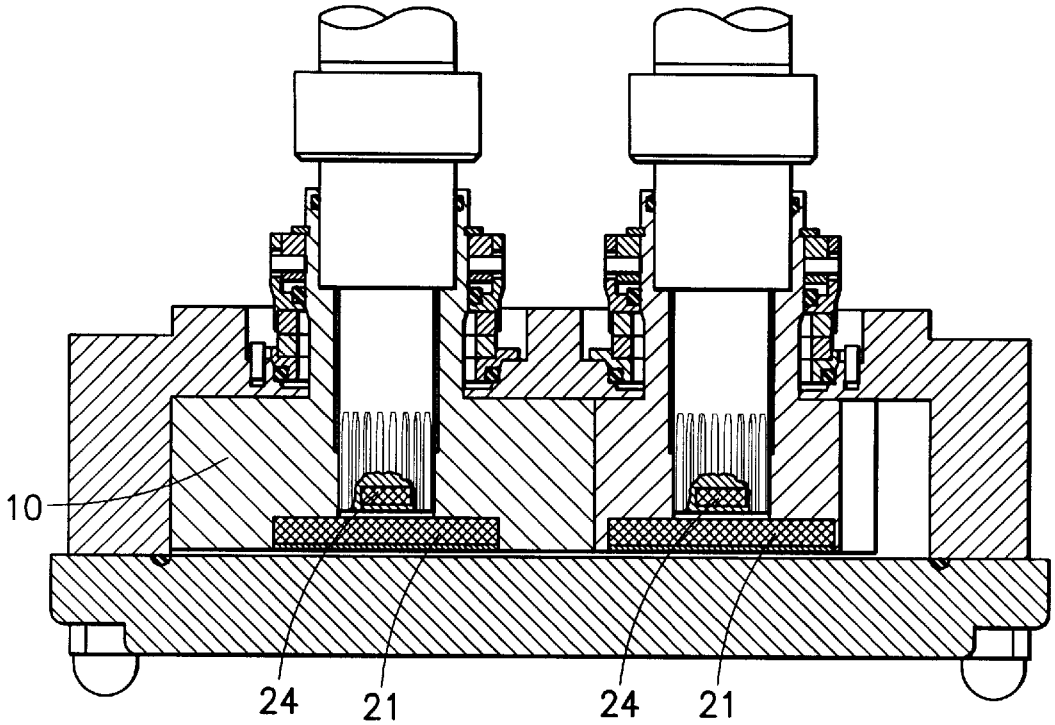
FIG. 4B shows a dual-rotor version thereof.
Figure 4C:
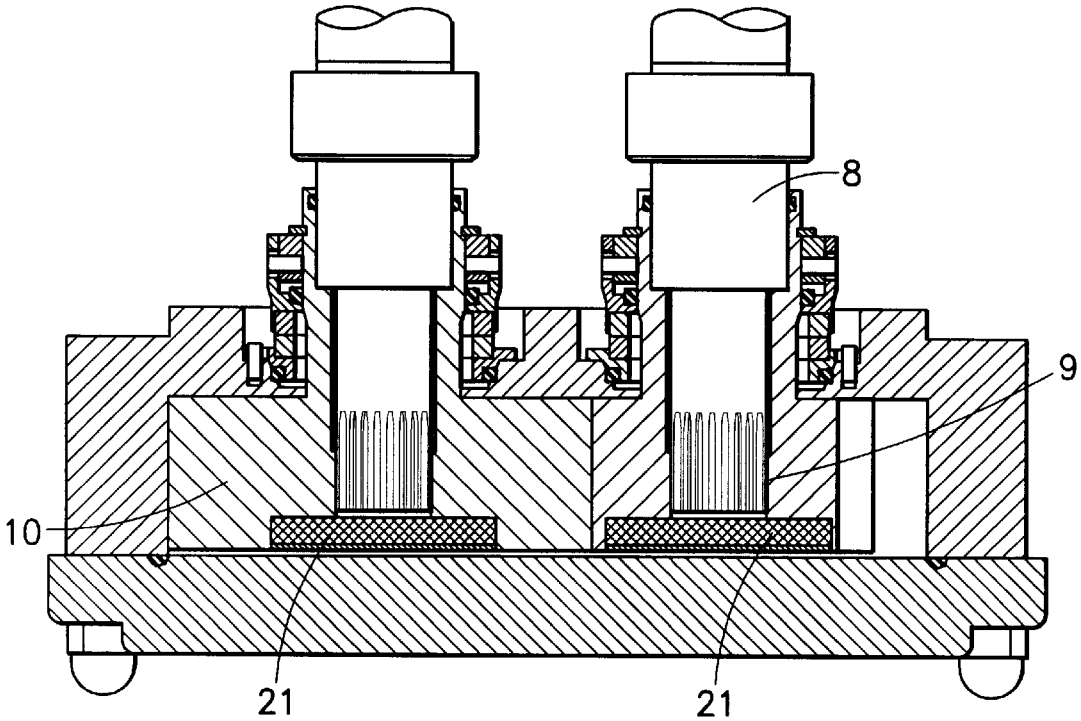
FIG. 4C shows a dual-rotor version omitting the drive shaft magnets.

In the embodiment illustrated in FIGS. 2A and 4C, a magnet 21 is fitted in the rotary lobe piston 10, so as to exert an attracting force on the end 9 of the drive shaft 8. The distance between the shaft end 9 and the magnet 21 is very small, and is defined such that the attracting force can be easily overcome, to remove the rotary lobe piston 10 from the pumping chamber. In FIG. 6 projections 36 are provided on the shafts which are attracted by magnets 21 in the pistons.

Figure 3A:
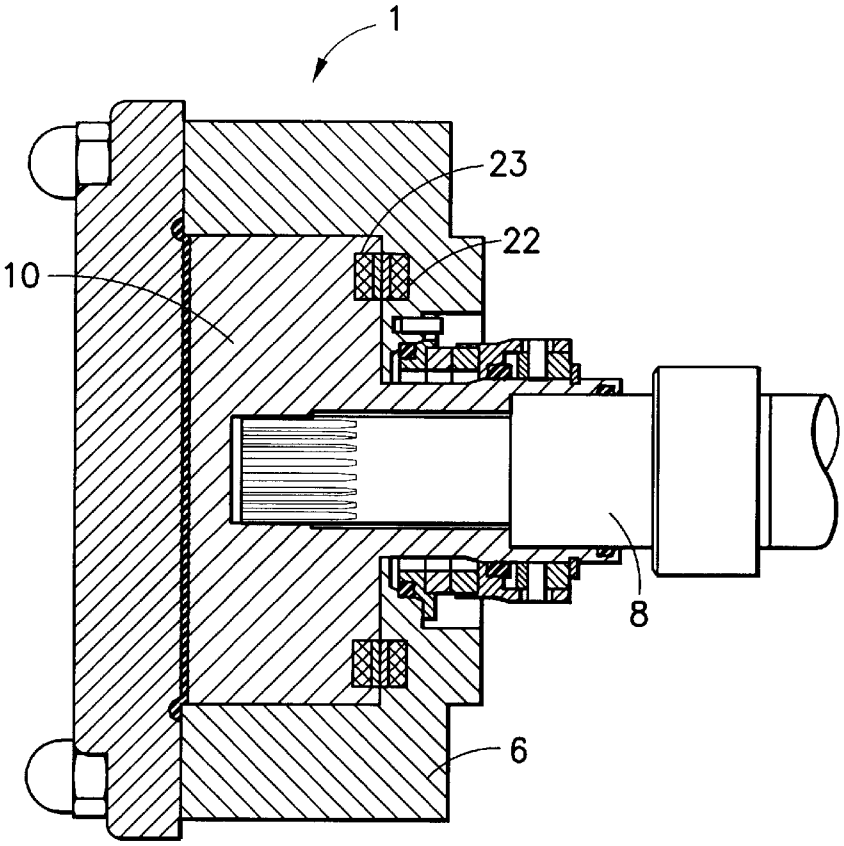
FIG. 3A shows a pumping chamber with a plurality of magnets fitted in the rear housing wall and in lobes of the rotary lobe piston.
Figure 3B:
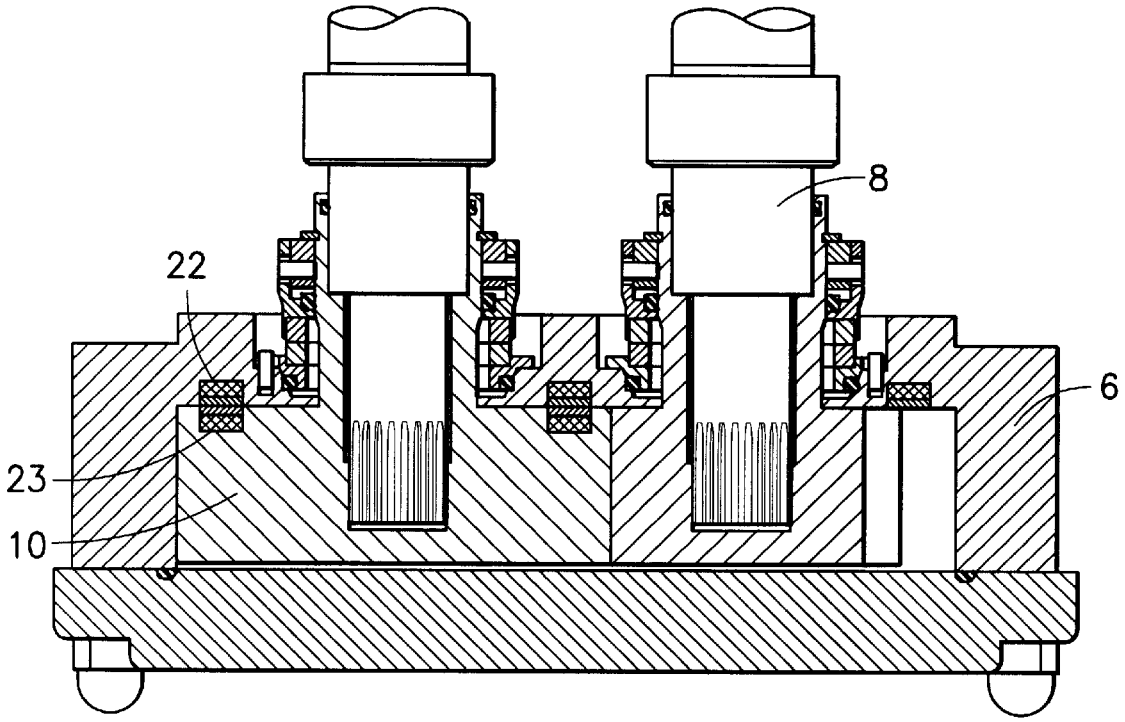
FIG. 3B shows a dual-rotor version thereof.
Figure 3C:
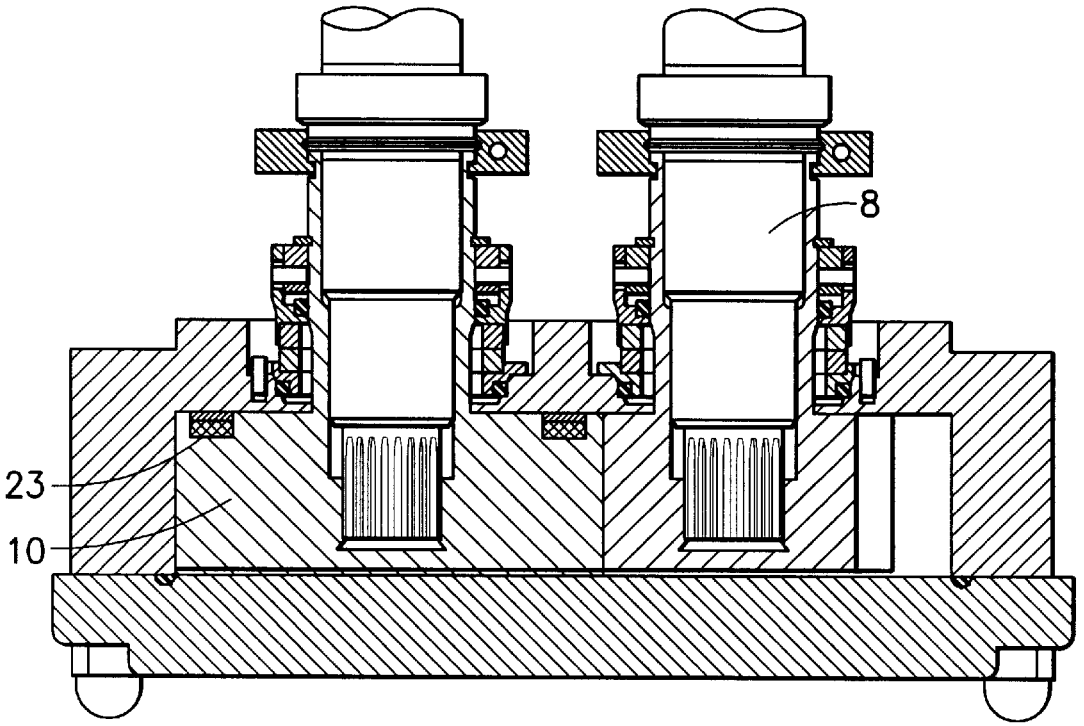
FIG. 3C shows a dual rotor version omitting the rear wall magnets.

FIGS. 3A and 3B depict a pumping chamber 1 with a rotary lobe piston 10 which is attracted by magnets 22 fitted in the rear housing wall. In order to increase this attracting force, additional magnets 23 with the appropriate complementary polarity are fitted in the lobes of the piston 10. The magnets 22 and 23 are arranged concentrically around the drive shaft 8. In FIG. 3C magnets 23 are provided only in the pistons 10 which exert an attracting force on the rear housing walls.

The embodiment according to FIGS. 4A and 4B corresponds to that shown in FIG. 2A, except for the fact that an additional magnet 24 is fitted in the end 9 of the drive shaft 10 to increase the attracting force exerted by the magnet 21 on the shaft end 9. Both magnets 21 and 24 have the same orientation, meaning that the adjacent magnet ends have opposite polarity, so that an attracting force is generated between the magnet ends.

In the rotary lobe pump embodiment of FIG. 5A, the repelling action of the magnets 15 and 16 (cf. FIG. 1) is combined with the attracting action of the magnets 22 and 23 (cf. FIG. 3A). A combination of several magnets allows the use of magnets of reduced force, thereby helping to prevent the formation of eddy currents while also ensuring a more uniform heat build-up in the rotary lobe piston and the pump chamber.

The centrally arranged and annular magnets are shaped so as to prevent imbalance forces when the pump is in operation. A magnet may be provided on a drive shaft end.

Various changes and modifications are possible within the scope of the inventive concept. In particular, features of one embodiment may be combined with features of another embodiment. Therefore, the present invention is not limited to the specific embodiments shown and described, but rather is defined by the following claims.

What is claimed is:

1. A rotary lobe pump, having a generally cylindrical housing including a front wall and a rear wall which receives a drive shaft of the motor, said front and rear walls together defining a pumping chamber within said housing;

at least one rotor revolving in said pumping chamber, said rotor being slidably placed on the end of said drive shaft projecting into said pumping chamber, further comprising a first magnet mounted in said front wall of said housing, and a second magnet mounted in a face of said rotor adjacent said front wall, the polarities of said magnets being selected such that the magnets repel each other, the magnetic force between said magnets acting to retain said rotor in axial position within said housing.

2. A pump as set forth in claim 1, characterized in that said magnetic force presses the rotor against a stop which prevents an axial displacement of the rotor on the drive shaft.

3. A pump as set forth in claim 1, characterized in that said magnetic force is produced by at least one permanent magnet acting upon another magnet.

4. A pump as set forth in claim 2, characterized in that said magnetic force is produced by at least one electromagnet acting upon another magnet.

5. A pump as set forth in claim 2, characterized in that said rotor axial stop is protected against ingress of contaminants by a seal (20) located between a rotor sleeve (13) and the drive shaft.

6. A pump as set forth in claim 1, characterized in that the pump is a rotary lobe pump having at least two rotors in the form of rotary lobe pistons.

7. A pump as set forth in claim 6, wherein said drive shaft is ferritic, and further comprising a magnet in the rotary lobe piston which exerts an attracting force on a front end of the ferritic drive shaft.

8. A pump as set forth in claim 6, characterized in that there are provided one magnet in the rotary lobe piston and one magnet in the front end of the drive shaft, the polarity of said magnets being selected such that these magnets attract each other.

9. A pump as set forth in claim 6, characterized in that the rotary lobe piston comprises an axial extension which carries at least one magnet, exerting an attracting force on a magnet or projection provided on the drive shaft.

10. A pump as set forth in claim 6, characterized in that there are provided magnets in the lobes of the rotary lobe piston to exert an attracting force on the rear housing wall.

11. A pump as set forth in claim 10, characterized in that there are provided magnets in the rear housing wall, their polarity being selected such that they exert an attracting force on the magnets in the lobes.

* * * * *